US009163503B1

(12) United States Patent
Travis

(10) Patent No.: US 9,163,503 B1
(45) Date of Patent: Oct. 20, 2015

(54) UTILITY MINE SCOOP AND MINE DUSTER

(71) Applicant: Tonny D. Travis, Prosperity, WV (US)

(72) Inventor: Tonny D. Travis, Prosperity, WV (US)

( * ) Notice: Subject to any disclaimer, the term of this patent is extended or adjusted under 35 U.S.C. 154(b) by 195 days.

(21) Appl. No.: 13/986,370

(22) Filed: Apr. 24, 2013

(51) Int. Cl.
*E01C 19/20* (2006.01)
*E21F 13/02* (2006.01)
*E21F 5/10* (2006.01)

(52) U.S. Cl.
CPC .. *E21F 13/02* (2013.01); *E21F 5/10* (2013.01)

(58) Field of Classification Search
CPC ..... E01C 19/20
USPC ..... 239/673, 661, 675, 676, 682, 687, 689, 239/664, 681; 222/252, 254, 272, 273, 330, 222/331, 334; 414/495, 497, 517; 118/305, 118/312, 313, 315
See application file for complete search history.

(56) References Cited

U.S. PATENT DOCUMENTS

| | | | | |
|---|---|---|---|---|
| 1,578,628 | A * | 3/1926 | Beatty | 169/64 |
| 2,521,888 | A * | 9/1950 | Wilson | 239/654 |
| 3,871,588 | A * | 3/1975 | Long et al. | 239/673 |
| 4,673,131 | A * | 6/1987 | Travis | 239/673 |
| 4,872,598 | A * | 10/1989 | Travis | 222/630 |
| 7,854,402 | B1 * | 12/2010 | Travis | 239/673 |
| 8,584,974 | B2 * | 11/2013 | Masloff et al. | 239/654 |

* cited by examiner

*Primary Examiner* — Justin Jonaitis

(57) ABSTRACT

A mine scoop machine having a steerable wheeled body provided with a material scoop having a load ejection blade mounted thereon for movement longitudinally of said body between a load position and a load ejection position adjacent an open front end of the scoop, operator controlled power means for moving the ejection blade selectively between the two positions for loading and unloading the scoop, a mine dusting unit mounted on the body rearwardly of the load position of the ejection blade, wherein the dusting unit comprises a dust hopper having a ground rock material feed inlet port and a rock dust outlet port, an air jet means on the unit for fluidizing the ground rock material and ejecting the resulting rock dust out into a mine shaft.

7 Claims, 8 Drawing Sheets

UTILITY MINE SCOOP AND MINE DUSTER

BACKGROUND OF THE INVENTION

This invention concerns a utility mine scoop machine with mine dusting capability, particularly for use in coal mines. The dusting aspect of the scoop can more effectively provide low levels of dust, e.g., limestone dust, of uniform densities or solids concentrations to the mine ventilation air currents for transportation thereby over substantial distances.

In underground coal mines, large amounts of coal dust are necessarily generated by the cutting, blasting, loading, crushing and the like of the coal. This dust not only is present in high concentrations at these sites but is carried by the mine ventilation air current from these sites, as well as from belt conveyor transfer point and locations along the belt conveyor where ventilation checks are installed, throughout the mines until it settles out on down stream surfaces. Such atmospheric dust, and settled-out dust accumulations are fire and explosion hazards and must be periodically cleaned up or made inert by addition of limestone rock dust.

There are several ways in which underground coal mines generate coal dust, (1) when the coal is cut from the coal seam, (2) when the coal is loaded into equipment that takes the coal to a feeder, (3) when the feeder crushes the coal, (4) when the feeder discharges the coal onto a conveyor belt and, (5) when the coal is discharged from one conveyor belt to the next conveyor belt.

This coal dust is carried by the ventilating air stream into the return ventilation air entries where it settles out in these entries and along the conveyor belt. The dust is also carried along the belt conveyor entries by the air stream in these entries.

Federal law requires that intake entries be 65% inert, and that return entries be 80% inert. Limestone dust is spread in the intake and return entries to get the needed percentages of inertness.

Federal law also does not allow coal dust to remain on top of surfaces underground. For example, an entry could have the percent inertness required but if coal dust is on top of the limestone dust and the entry is black with coal dust, a violation of federal law could be cited.

To keep the return entries and belt conveyor entries white, a limestone distributor called a Trickle Duster is typically employed as shown in U.S. Pat. No. 4,872,598 the disclosure of which is hereby incorporated herein by reference in it entirety. These dusters have an air blower and a tank that holds limestone (rock) dust. The blower discharge air goes into the tank typically up thru the limestone dust and fluidizes the dust. A small portion of the limestone dust is carried by the air stream and is continuously discharged into the entries. The trickle duster discharges a continuous fog of limestone dust that is carried by the ventilation air and helps to keep the return entries and conveyor belt entries white.

With reference to an alternative embodiment of trickle duster, anytime air is taken underground and is warmer than the underground ambient temperature (normally 50-55° F.), a condition of 100% humidity or so is present. In summer months, all surfaces in an underground coal mine are wet. The air that is blown into the limestone dust is at about 100% humidity and the limestone dust absorbs water during its fluidization which causes particles of the dust to become heavier and to stick together. When this limestone dust is discharged into the air stream entries, it will not travel as far and will not uniformly coat surfaces within the mine because it is wet and particles of the dust have agglomerated.

In one preferred embodiment of the present invention, the duster structure is shown in FIG. 1 in cross-section and delivers limestone dust and pressurized air to the mine entries rapidly whereby the dust will only be exposed to the high humidity air from the ambient air from a blower for a short period of time in the delivery hose as compared to prior dusters which are designed to form dust-in-air suspensions within the dust feed hopper apparatus. Employing this duster, limestone dust will travel a greater distance in the entries since it is dry and particles of dust will not be stuck together. This preferred duster employs an auger in the bottom of a vee bottom tank, an air blower and preferably with the addition of a vibrator on at least one sloped side wall to aide in dust movement to the auger and specially designed dust discharge structure which produces a substantially dry dust-in-air discharge stream. By mounting the duster on a battery powered scoop such as shown in FIGS. 5-7, the duster can be transported within the mine, e.g., wherein the mine shaft is only 2 or 3 feet high, by commonly used scoop equipment to any location that the scoop equipment can go. This feature allows for total dust penetration throughout the mine. The motorized structure of the duster preferably is battery operated but can use any power source. Other commonly used dusters can be used, but the one shown in FIG. 1 is preferred.

BRIEF DESCRIPTION OF THE DRAWINGS

The invention will be understood further from the drawings herein and their description wherein the figures are not drawn to scale or consistent proportions, and wherein.

DETAILED DESCRIPTION

Figure 1:
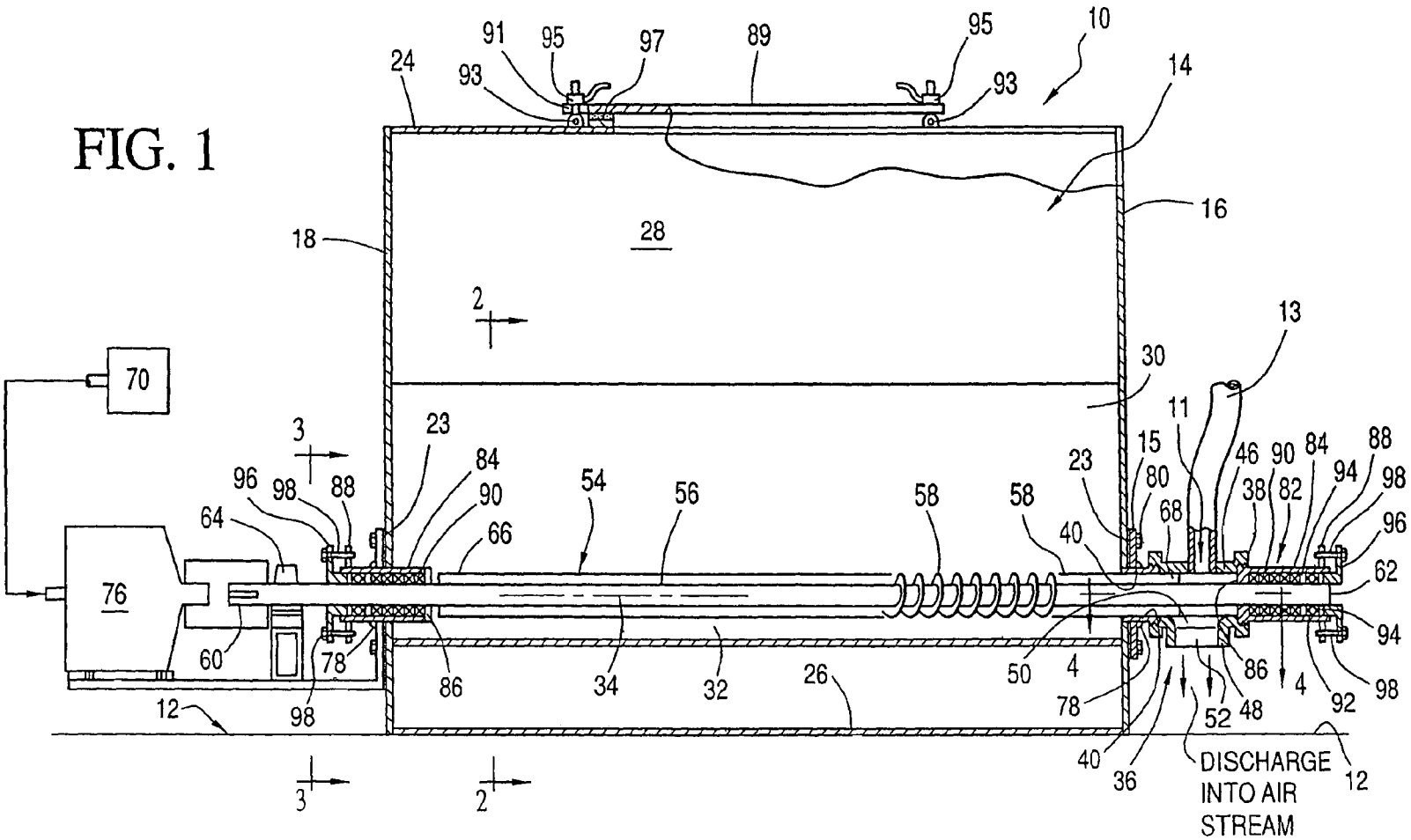
FIG. 1 is an inside view (structures substantially in proportion) of the present preferred duster with the near side section removed and certain structures shown in cross-section.

Referring to the drawings the preferred trickle duster apparatus 10 comprises a base frame 12 which may be provided with wheels for easy transport, supports a dust hopper 14 formed with front 16, rear 18, side 20,22, top 24 and bottom 26 wall sections forming a material feed chamber 28, lower portions 30 of at least one of the side sections being slanted inwardly to form an auger well 32 having a longitudinal axis 34 running thru the front and rear wall sections.

A typical vibrator 21 useful with the present invention is the "Dayton" 2P Series 6L740 giving an adjustable force, e.g., 450 lbs. at 115/230 volts, single phase at 3600 RPM shown on page 234 of GRAINGER Catalog No. 402.

A dust discharge structure 36 preferably affixed to a mounting plate 15 has a front 38, rear 40, side 42, 44, top 46 and bottom 48 wall means forming an auger discharge cavity 50 thru which axis 34 runs. This structure is mounted on front wall section 16 of the hopper via plate 15 with said rear wall means 40 of the discharge structure adjacent and sealed to front wall section 16. An air inlet port 11 is provided on structure 36 and is adapted for connection to the exhaust 74 of blower 72. A dust outlet port 52 on the discharge structure communicates with cavity 50. Plate 15 preferably is welded or the like as at 78 to 40 and is preferably bolted as at 80 to 15 such that the discharge structure can be slid off of the auger should repairs be needed.

Affixed to the front wall means 38 of the dust discharge structure is a front bearing assembly generally designated 82 and comprising a sleeve member 84 having an inner end 86 formed as a retaining shoulder and having an outer end affixed to a bolt flange 88 as part of a packing gland. Within said member 84 is sealing packing 90, bearing 92 and spacer washer 94. Packing gland flange 96 is adapted to be pressured against bearing 92 and packing 90 by bolts 98.

An auger 54 is provided having a shaft 56 supporting a flyght section 58, said shaft having a drive end 60 and a front end 62 and is mounted axially in well 32 with the front end extending axially thru the front wall section 16 of the hopper and thru and beyond the rear 40 and front 38 wall means of the discharge structure. End 62 is axially rotatably supported by second bearing means 92 mounted on the front wall means of the discharge structure as described above. The drive end of the shaft extends thru the rear wall section of the hopper and is rotatably supported by first bearing means 64 located exteriorly of chamber 28. A packing gland similar to that used for the front end 62 of shaft 56 receives the drive end 60 of the shaft and the equivalent parts of this gland to those at end 62 are numbered the same.

Flight section 58 has a rear end 66 and a discharge end 68, said discharge end extending axially thru the front wall section 16 of the hopper and the rear wall means 40 of the discharge structure and opens within and is adapted to discharge into discharge cavity 50. The rear end 66 of the flight section resides within the auger well. Motor 70 on the duster drives a speed reducer 76 which drives said auger. Dust seals 23 are provided.

Figure 7:
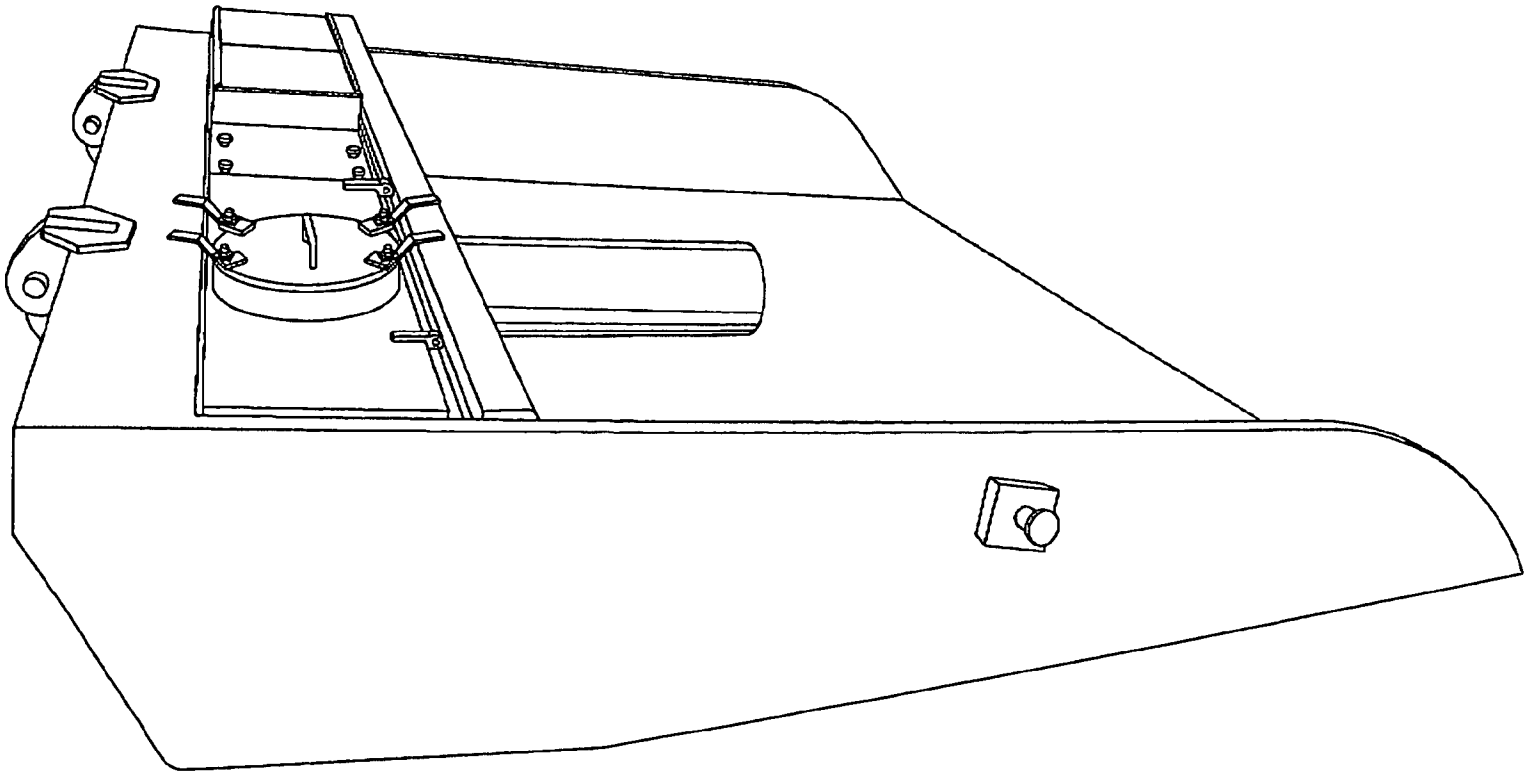
FIG. 7 is a view as in FIG. 6 showing the ejection jack and blade location.
Figure 8:
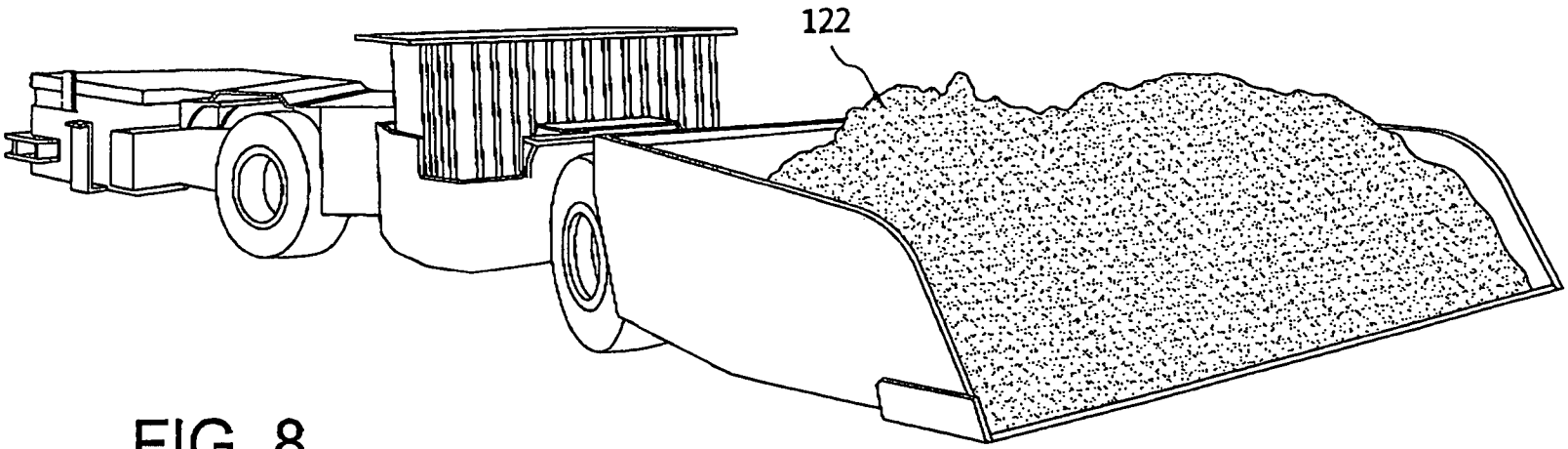
FIG. 8 shows a conventional scoop machine carrying a load of mined coal.
Figure 9:
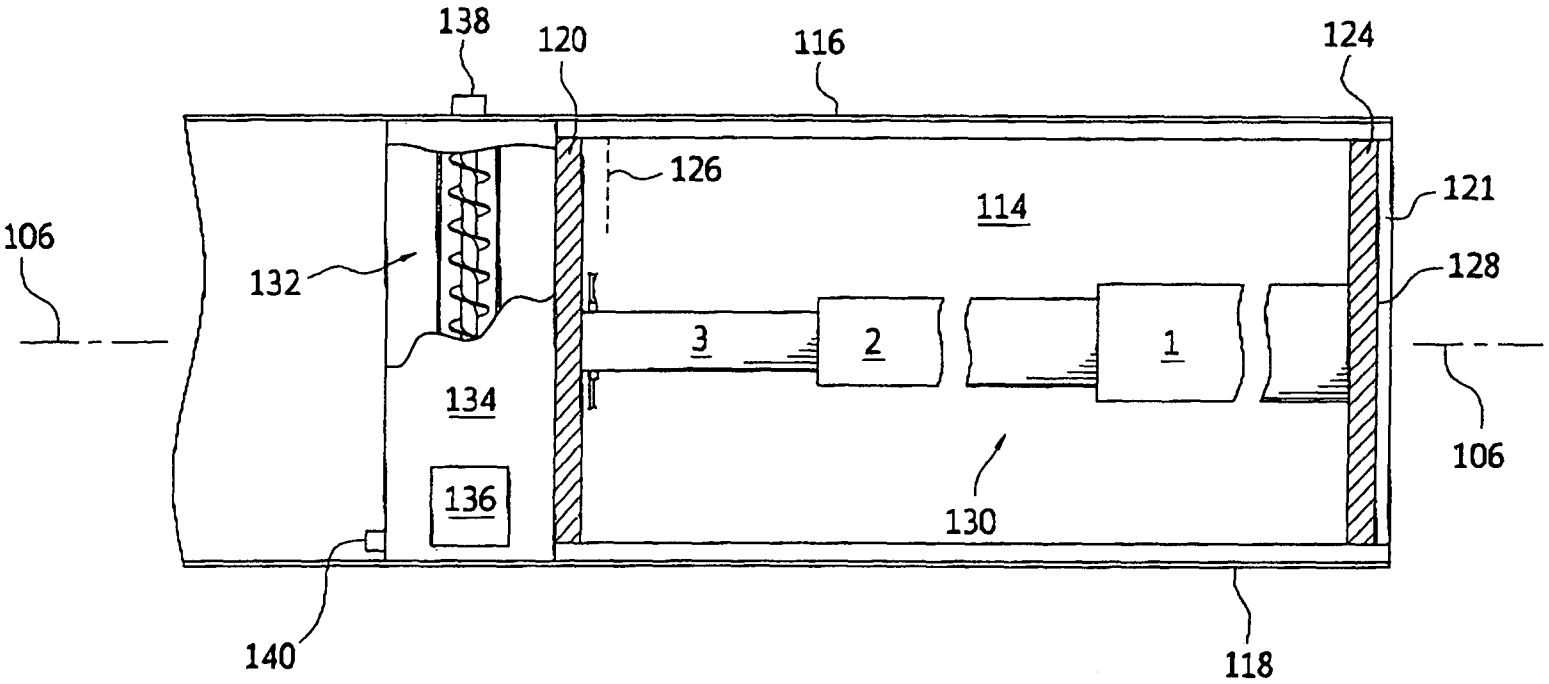
FIG. 9 is top view of the basic construction of the hydraulic jack, scoop and duster means.

Referring to FIGS. 1 and 7, the access hatch cover 89 is provided with slots 91 into which pivot bolts 93 nest to allow nuts 95 to be tightened down against cover 89 and compress a dust seal 97.

Figure 1A:
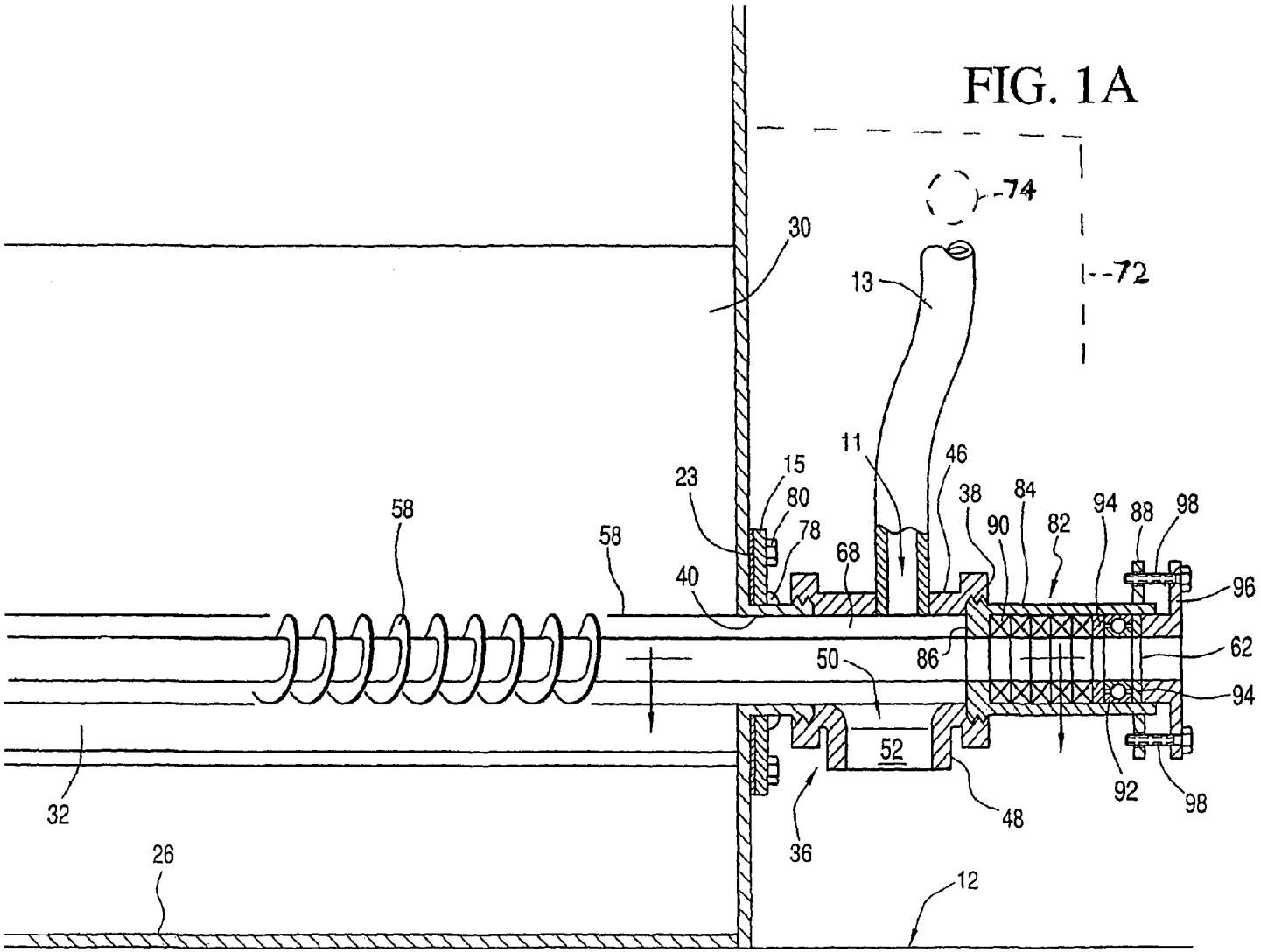
FIG. 1A is an enlarged cross-sectional view of the discharge section of the duster of FIG. 1.
Figure 2:
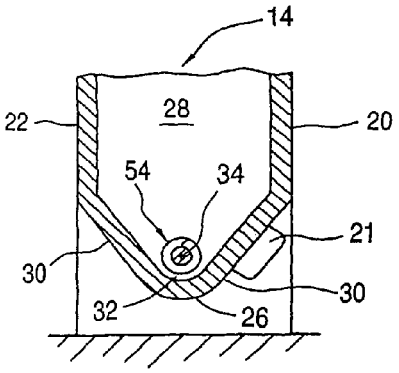
FIG. 2 is a cross-sectional view taken along line 2-2 in FIG. 1 with typical structural dimensions shown.
Figure 3:
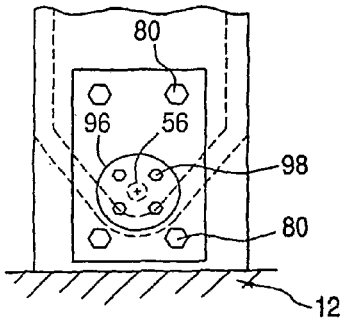
FIG. 3 is an end view of the hopper taken along line 3-3 in FIG. 1.
Figure 4:
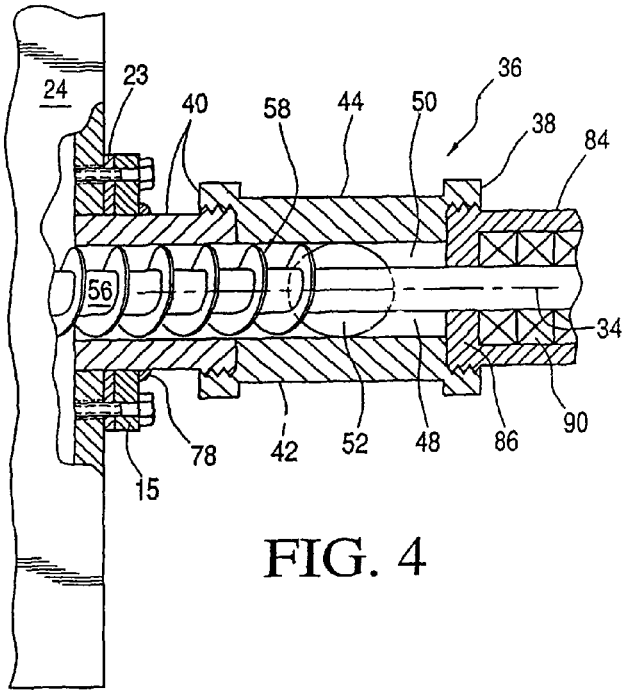
FIG. 4 is a cross-sectional view of the discharge structure and adjacent hopper structure taken along line 4-4 of FIG. 1.
Figure 5:
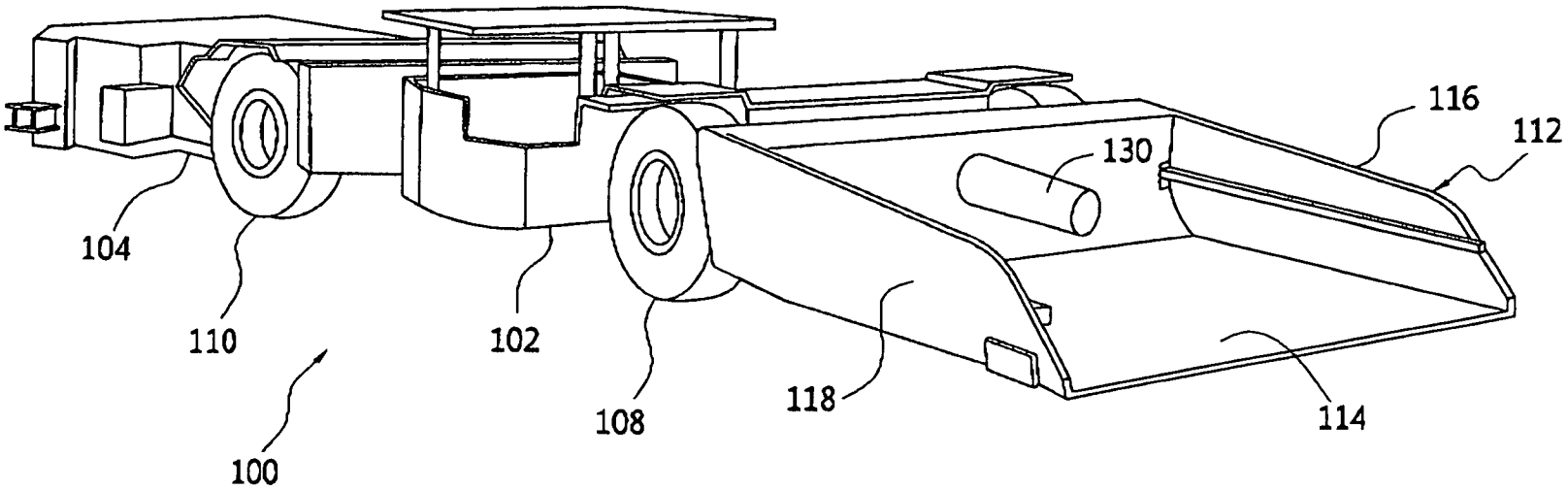
FIG. 5 is a view of a typical utility scoop mining machine.
Figure 6A:
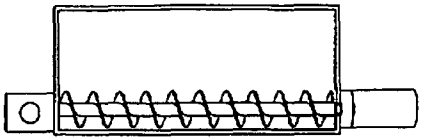
FIG. 6 shows views of the present duster arrangement on the scoop machine of FIG. 5.
Figure 6B:
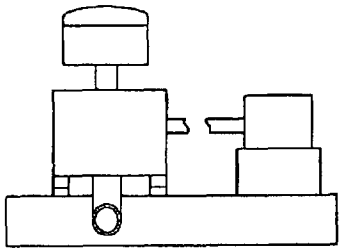
Figure 6:
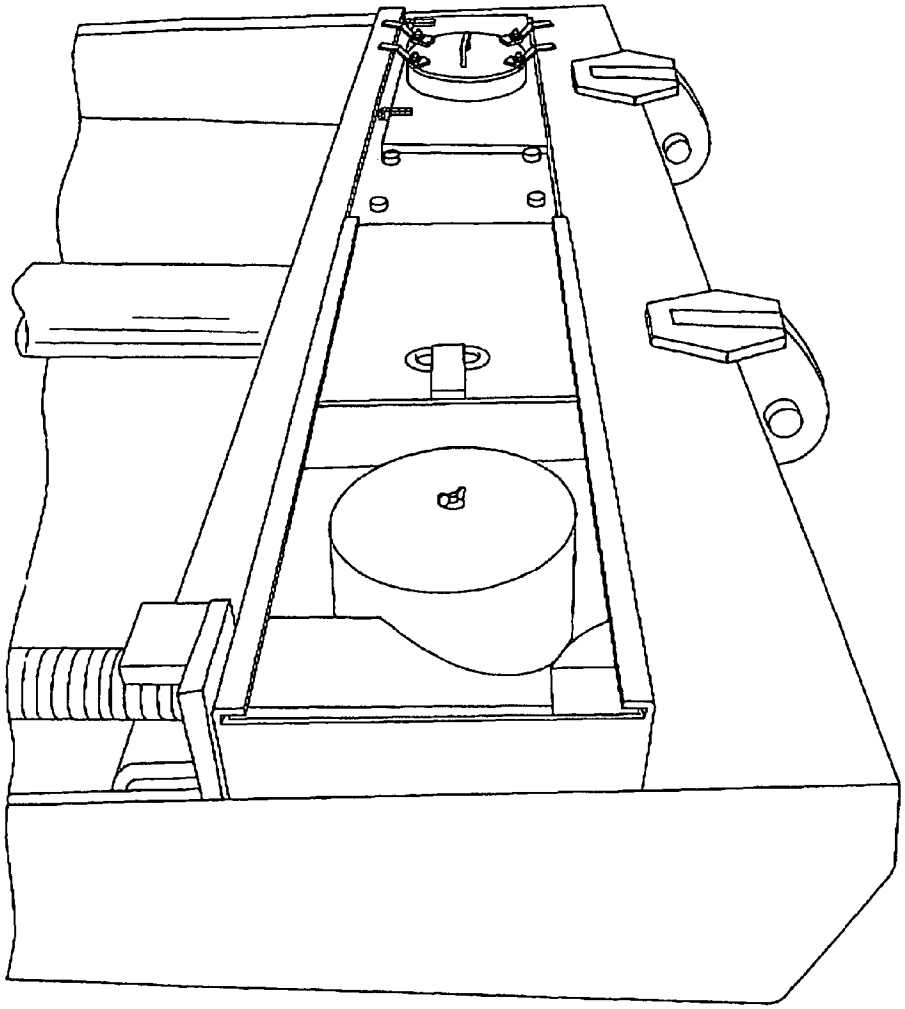

An air blower 72 (dotted line in FIG. 1A) is mounted on either (a) the duster base frame 12 exterior to the hopper and has a blower exhaust 74 connected into inlet port 11 by hose 13 or equivalent means. This blower preferably is battery powered.

Following is an example of structural dimensions and operating parameters representing the best mode known to applicant for practicing the present invention.

(a) Hopper Capacity—700 lbs.
(b) Auger Shaft 2" Diameter 1.5 lbs/min.
(c) Auger Flight Diameter 2.44 in.
(d) Auger Pitch—2 in.
(e) Auger Speed—11 RPM.
(f) Auger Length—36 inch of Flight.
(g) Blower Mounted on Duster—50 to 60 CFM at 5 PSI, 5 HP ELEC. 1,800 RPM., Air filter in line to dust discharge cavity.
(h) Vibrator can produce 400 lbs of force.
(i) Vibrator is set at 300 lbs of force.
(j) A full hopper will run to empty in 8 to 10 hr.
(k) Blower air and dust mixed in discharge cavity and ejected to delivery hose at about 1.5 lbs. 1 per min.
(l) Delivery hose up to about 500 ft. long.
(m) Hopper is sealed by a top fill hatch cover.
(n) Pump type packing around auger shaft.

1) Once the pre-operational checks are made, remove the wing nuts from the hatch cover and lay the cover to the side.
2) Add up to 700 lbs of dry rockdust to the hopper, being careful not to introduce any foreign objects such as coal, slate or torn portions of the rockdust bag. Warnings: wet dust may cause the machine to malfunction.
3) Once the hopper is filled, replace the hatch cover and tighten all wing nuts.
4) Assure all by-standers are away from the discharge end of the dusting hose.
5) Press the motor start button on the control panel. This will start the motor and auger. The vibrator will have about a 2 minute delay, will run for 30 seconds, and then repeat the cycle until the machine is shut down. Note: The off-time and run-time of the vibrator can be adjusted. The recommended cycle is 2 minutes off and 30 seconds on. This allows the vibrator to cool.
6) Check the discharge end of the dusting hose to assure that a steady flow of dust is coming out of the hose. If dust is not flowing from the hose shut the machine down and refer to the trouble shooting portion of this manual.
7) Hang the hose as close to the mine shaft top as possible and down-stream of the duster. Point the hose in the direction of the air flow.
8) The duster will discharge up to 90 lbs per hour so the machine will empty in approximately 7-8 hours. When re-filling, de-energize before opening the hatch.
9) Up to 300 feet of 2" rockdust hose may be used. Using hose smaller than 2" or dusting distances more than 300 feet will lead to increased backpressure and will shorten blower life.

The preferred mine scoop machine comprises a body structure generally designated 100 having a front end section 102 and a rear end section 104, said front end section having a longitudinal axis 106, support wheels 108 on said front end section and steering wheels 110 on said rear end section, a material scoop 112 on said front end section of said body, said scoop having a bed portion 114, upstanding opposing side portions 116, 118, and an upstanding rear wall portion 120, said front end section being open at 121 to allow for insertion of said bed portion under a material load 122, a load ejection blade 124 mounted on said scoop for movement longitudinally of said scoop between a load position 126 adjacent to said upstanding rear wall portion and a load ejection position 128 adjacent said open front end section, operator controlled power means piston 130 having telescoping sections 1, 2 and 3 for moving said ejection blade selectively between said positions for loading and unloading said scoop, a mine dusting unit 132 mounted on said front end section of said body rearwardly of said load position of said ejection blade, said dusting unit comprising a dust hopper 134 having a ground rock material feed inlet port 136 a rock dust outlet port 138, an air jet means 140 on said unit for fluidizing said ground rock material and ejecting the resulting rock dust out into a mine shaft.

The invention has been described in detail with particular reference to preferred embodiments thereof, but it will be understood that variations and modifications will be effected within the spirit and scope of the invention.

I claim:

1. A mine scoop machine comprising a body structure having a front end section and a rear end section, said front end section having a longitudinal axis, support wheels on said front end section and steering wheels on said rear end section, a material scoop on said front end section of said body, said scoop having a bed portion, upstanding opposing side portions, and an upstanding rear wall portion, said front end section being open to allow for insertion of said bed portion under a material load, a load ejection blade mounted on said scoop for movement longitudinally of said scoop between a load position adjacent to said upstanding rear wall portion and a load ejection position adjacent said open front end section, an operator controlled power means for moving said ejection blade selectively between said positions for loading and unloading said scoop, a mine dusting unit mounted on said front end section of said body rearwardly of said load position of said ejection blade, said dusting unit comprising a dust hopper having a rear wall section a front wall section, a bottom wall section and side wall sections, and a top hatch cover, a rock dust transport auger having a shaft supporting an auger flight section is positioned in a lower portion of said hopper and extending outwardly through said front wall section and through rock dust discharge structure affixed to the exterior surface of said front wall section of said hopper, said discharge structure having an augered dust discharge cavity into which said auger extends and into which the augered dust is received, said discharge cavity having a dust outlet port and an air inlet port, a source of pressurized air is positioned external to said hopper and is connected into said air inlet port externally of said hopper, whereby the pressurized air will rapidly jet the dry dust out through said dust outlet port for transport to and through a mine dusting conduit without any significant exposure of the dust to ambient moisture.

2. The machine of claim 1 wherein a vibration means is affixed to said hopper for preventing dust agglomeration accumulation on the hopper walls.

3. The machine of claim 2 wherein said hopper is generally rectangular in lateral cross section and wherein each of said side wall sections include a lower portion, said lower portions of both side sections are slanted inwardly to form said an auger well.

4. The machine of claim 1 wherein a front end (62) of the auger shafts (56) is rotationally mounted in a front bearing assembly (82) comprising an axially oriented elongated structure sleeve having an aft end (86) affixed to a front wall means (38) of the dust structure 36, and having a fore end containing a shaft end bearing (92) thru which the front end of the auger shaft is mounted, a seal packing is provided in the sleeve structure and surrounds a portion of the front end of the auger shaft, and a packing gland is provided on the fore end of the sleeve structure and is adapted to compress the seal packing (90) between the front wall means (30) of the discharge structure and a spacer washer (94) which separates the packing from the shaft end bearing.

5. The machine of claim 4 wherein the rear wall means of the discharge structure is affixed to a mounting plate which is removably affixed to said front wall section of said hopper.

6. The machine of claim 5 wherein said drive end of said shaft is mounted thru said packing gland which is affixed to said mounting plate which is removably affixed to said rear wall section of said hopper.

7. The machine of claim 1 wherein the source of pressured air is an air blower which delivers 50 to 60 CFM at 5 PSI, having an air filter in a blower exhaust line which line is connected by a hose means directly to said discharge structure.

* * * * *